US006126876A

United States Patent [19]

Demarzo

[11] Patent Number: 6,126,876

[45] Date of Patent: Oct. 3, 2000

[54] SYSTEM FOR CONDITIONING SAND FOR SCULPTING PURPOSES

[76] Inventor: Anne T. Demarzo, 58 Buttonwood Rd., Staten Island, N.Y. 10304

[21] Appl. No.: 09/193,817

[22] Filed: Nov. 17, 1998

[51] Int. Cl.[7] ..... B29C 67/00

[52] U.S. Cl. ..... 264/109; 264/349

[58] Field of Search ..... 264/109, 349

[56] References Cited

U.S. PATENT DOCUMENTS

| | | | |
|---|---|---|---|
| 1,248,532 | 12/1917 | Noyes . | |
| 1,610,121 | 12/1926 | Dickinson . | |
| 1,639,934 | 8/1927 | Ferring . | |
| 3,691,672 | 9/1972 | Pendill | 46/16 |
| 3,956,437 | 5/1976 | Ellis | 264/40 |
| 4,246,953 | 1/1981 | Johnson | 164/7 |
| 4,780,980 | 11/1988 | McCullough | 43/17.5 |
| 5,460,561 | 10/1995 | Dahlgren | 446/117 |

*Primary Examiner*—Mary Lynn Theisen
*Attorney, Agent, or Firm*—Goldstein & Canino

[57] ABSTRACT

A method and apparatus for conditioning sand prior to creating a sculpture therewith. The apparatus comprises a flexible sheet having a left side, a right side, a top edge, a bottom edge, and a plurality of hook and loop fasteners on the left side and the right side. The system comprises creating a mold by engaging the fasteners on the left side and the right side, filling the mold with sand to an appropriate level, pouring water into the mold and allowing the water to sift through the sand therein, and replenishing sand drained away by the poured water. The process of pouring water into the mold and replenishing the drained sand is continuously repeated, until no more replenishment is necessary and a solid column of sand is created. The fasteners are then disengaged, and the mold unwrapped to reveal the column of sand, ready for sculpting.

3 Claims, 4 Drawing Sheets

15
55
51
41
10
43

SYSTEM FOR CONDITIONING SAND FOR SCULPTING PURPOSES

BACKGROUND OF THE INVENTION

The invention relates to a system for conditioning sand for sculpting. More particularly, the invention relates to a system for conditioning sand for sculpting using a flexible and adjustable mold.

People go to the beach to spend their free time relaxing and unwinding from their normal work routines. Once on the beach, one generally engages is leisurely activities, such as sunbathing, swimming, recreational reading, listening to music, painting or the like. Building sand castles and sculpting in the sand is one of the most popular beach activities.

Various molds for facilitating the sculpting process have been disclosed. For example, U.S. Pat. No. 3,691,672 to Pendill discloses a building unit for use with sand and comprises shaped complemental edifices that are hollow. U.S. Pat. No. 5,460,561 to Dahlgren discloses a toy kit with individual pieces that can be used as molds for building structures such as sand castles. Unfortunately, the known molds are bulky and difficult to carry.

Because of the inconvenience in carrying bulky molds, most people endeavor sculpting with their bare hands. Before one can create a sand castle, sand is collected into a pile and then sculpted thereon. Unfortunately, it is difficult to compactly organize dry sand into a column for sculpting a sturdy sand castle therewith. On the other hand, adding water washes the sand particles away and weakens the column, which again makes it difficult to sculpt a sturdy sand castle thereon.

Accordingly, there is a need for a system to aid in sculpting sturdy structures in the sand. It should be noted that while the existing methods and devices may be suitable for general usage, they are not as suitable for the purposes of the present invention as disclosed hereinafter.

SUMMARY OF THE INVENTION

It is an object of the invention to provide a method and apparatus for conditioning sand to sculpt thereon.

It is a further object of the present invention to provide a flexible sheet that forms a mold to create sand structures of different sizes therewith.

It is another object of the invention to disclose a method that aids novices with sculpting on sand or other synthetic sand substitutes. Accordingly, the present invention discloses a lightweight mold for conditioning sand to sculpt thereon. The conditioned sand is formed into a rigid column and structures may be securely sculpted thereon.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

The above and other aspects, features and advantages of the present invention will be more apparent from the following detailed description thereof, which is presented in conjunction with the following drawing.

DETAILED DESCRIPTION OF THE PREFERRED EMBODIMENTS

Figure 1:
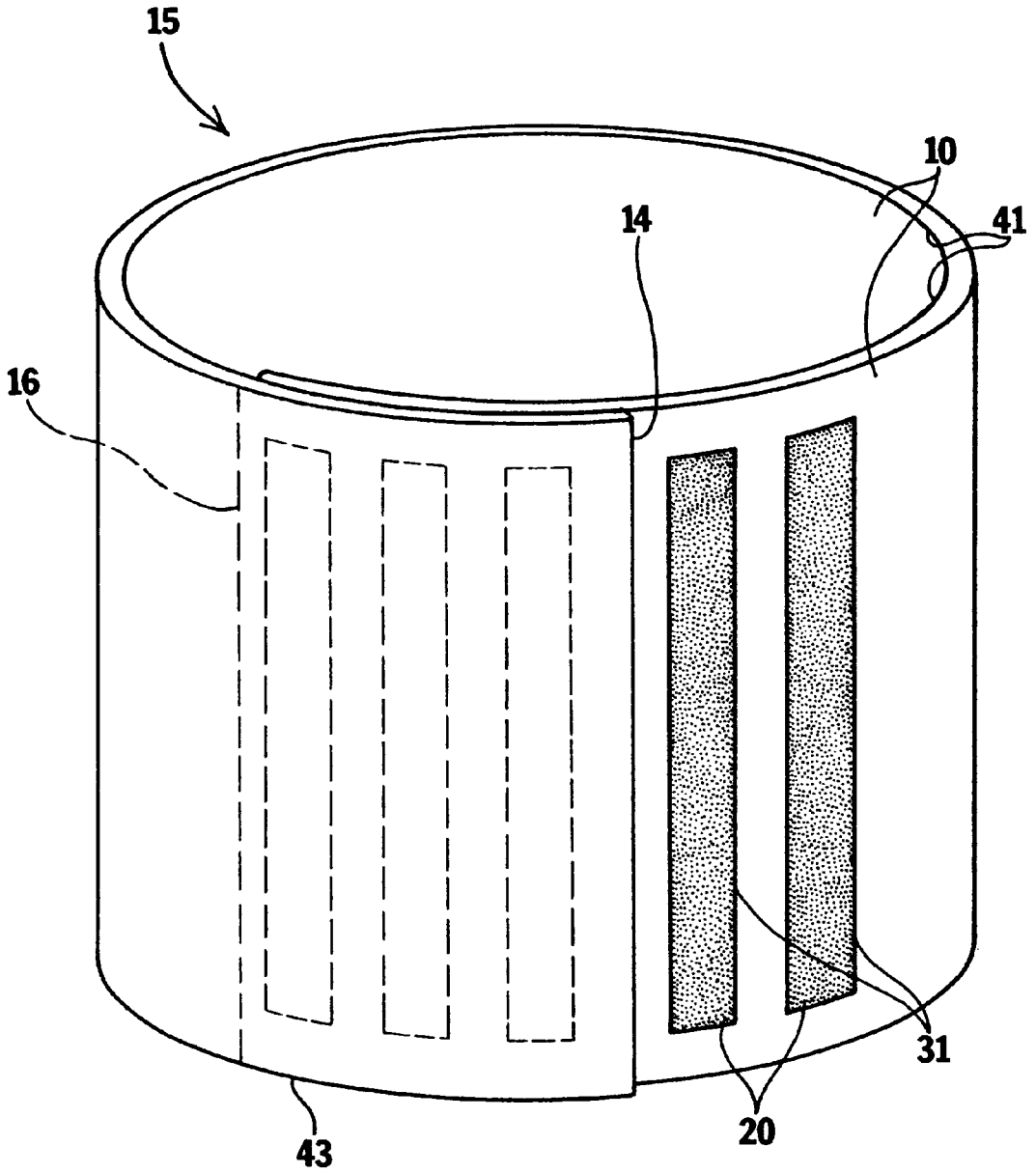
FIG. 1 is a diagrammatic perspective view of a mold formed from a light-weight flexible sheet, in accordance with the present invention.

FIG. 1 shows a mold 15, which is constructed from a flexible sheet 10. To allow portability, the flexible sheet 10 is constructed from a light-weight material, such as plastic, polyvinyl chloride (known generally as PVC), rubber or the like.

The sheet 10 has a left side 14, a right side 16, a top edge 41, and a bottom edge 43. A plurality of fastening means 20 are provided on the left side 14 and the right side 16 of the sheet 10. The fastening means 20 attach the left side 14 to the right side 16 and thereby define a cylindrical interior spine mold 15. It is preferable that the fastening means 20 be hook and loop type fasteners for allowing easy attachment and detachment of the left side 14 and the right side 16.

The fastening means 20 are provided in a plurality of strips 31, which are arranged parallel to the left side 14 and the right side 16. The strips 31 are located at fixed predetermined distances from the left side 14 to selectively increase or decrease the diameter of the mold 15.

According to the invention, the user rolls the left and right edges of the sheet 10 together, and attaches the left side 14 and the right side 16 to form the desired mold 15, as shown in FIG. 1. Once the desired mold 15 has been formed, the user places it on the ground, such that the bottom circumference 43 rests securely thereon.

Figure 2:
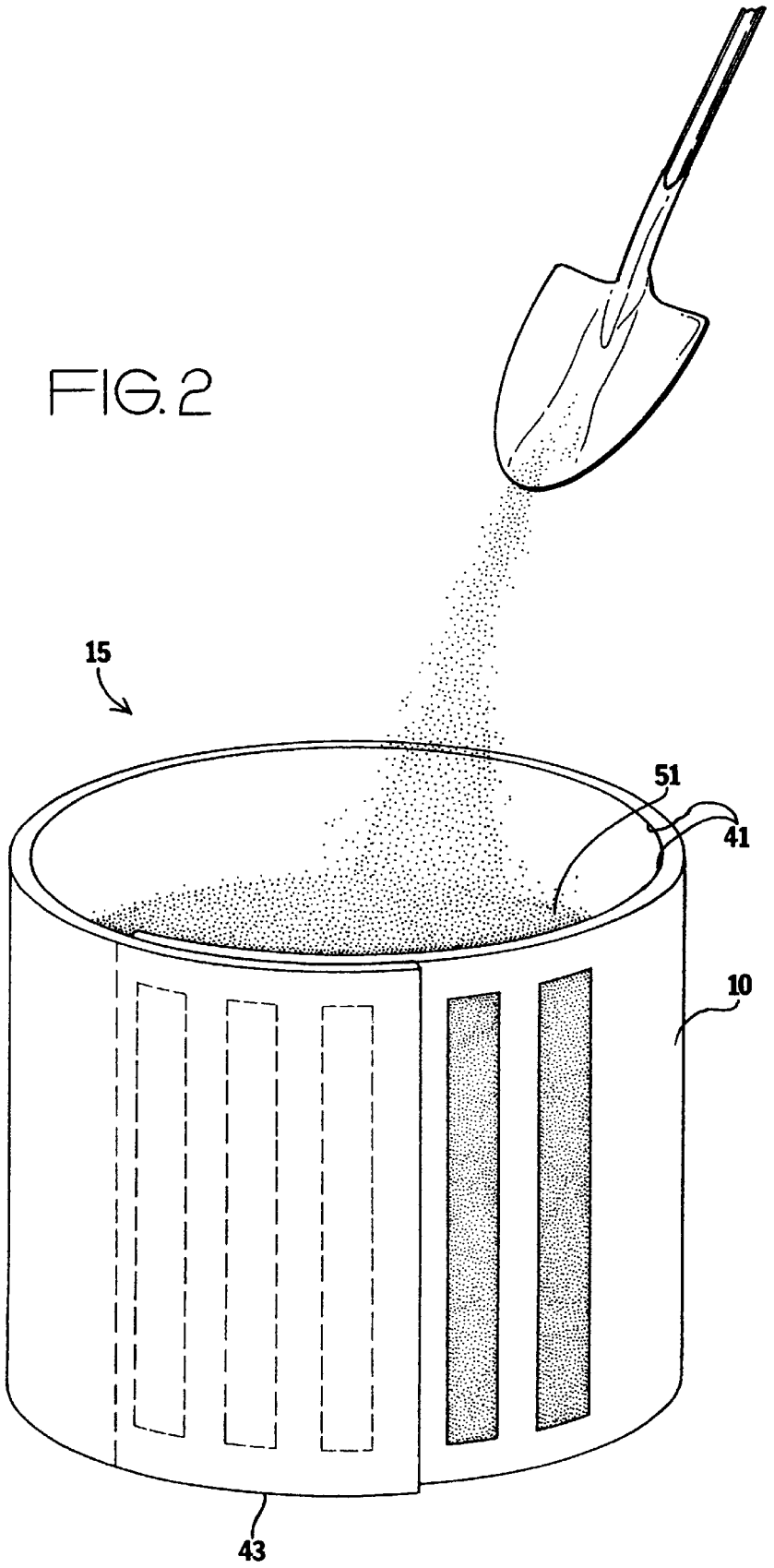
FIG. 2 is a diagrammatic perspective view of a mold with sand being poured therein.

As shown in FIG. 2, sand 51 or another sand substitute is poured into the mold 15 until an appropriate amount of sand 51 has been filled therein. As is well known, dry sand is typically granular in form with air trapped therebetween, which makes it difficult to organize the sand 51 into a compact rigid structure 61.

Figure 3:
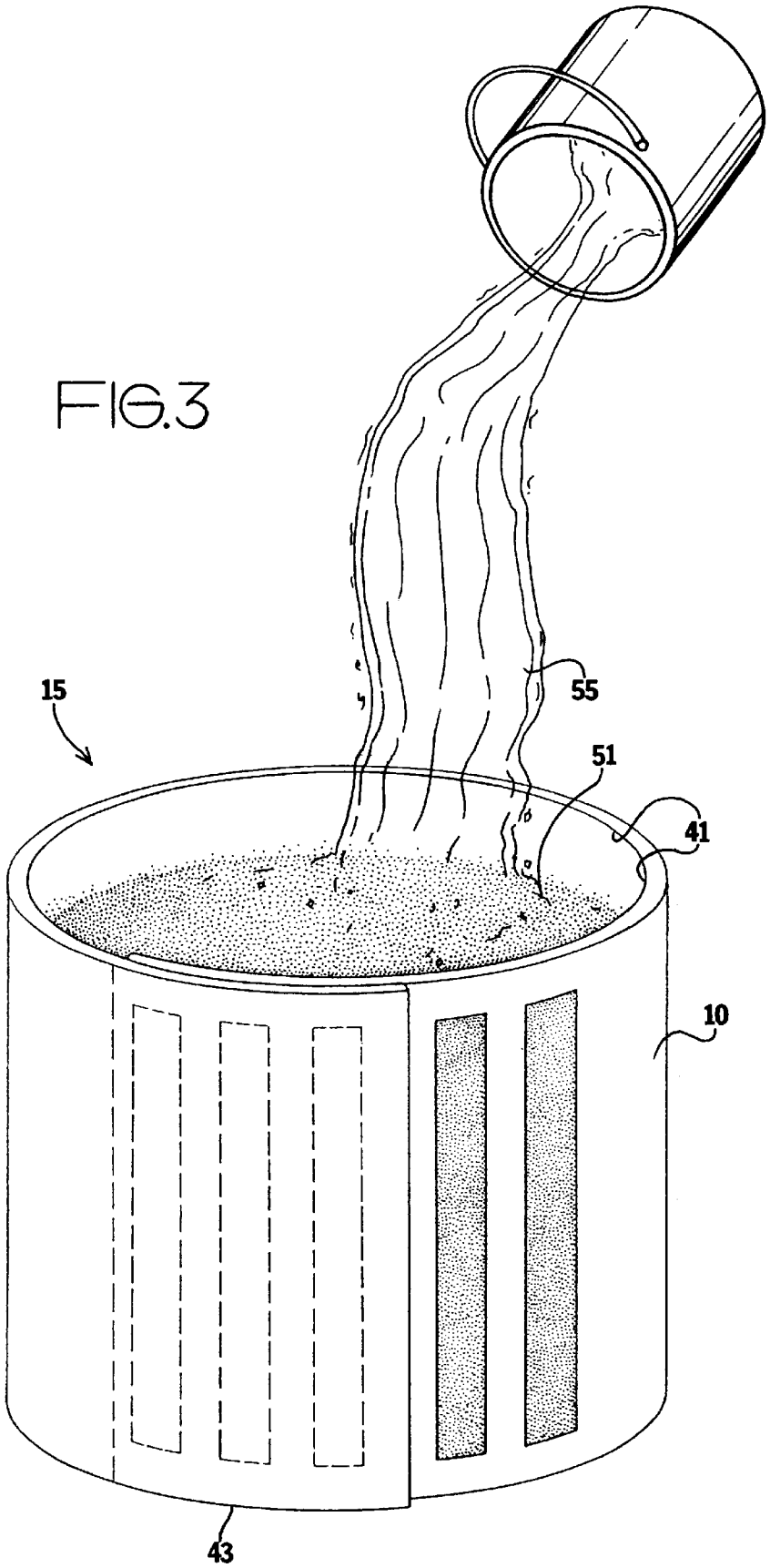
FIG. 3 is a diagrammatic perspective view of a mold having sand therein with water being added thereto, in accordance with the present invention.

To condition the sand for forming a rigid structure, water 55 is poured into the mold 15, as shown in FIG. 3, and allowed to sift through the sand 51 therein. The water 55 drains out from under the bottom edge 43. Unfortunately, the drained water 55 carries along some of the sand 51 from within the mold 15. As a result, the mold 15 is replenished with sand to compensate for the drained sand, and water 55 is poured therein once again. The water 55 is again allowed to sift through the sand.

The process of replenishing the sand 51 and then pouring water 55 therethrough is repeated until the amount of the sand 51 draining out of the mold 15 is substantially reduced. It should be noted that when water 55 is drained through the sand 51, it removes air bubbles trapped therebetween. Consequently, the sand 51 within the mold 15 continues to become rigid, wherein the rigidity increases every time water 55 is sifted therethrough.

Figure 4:
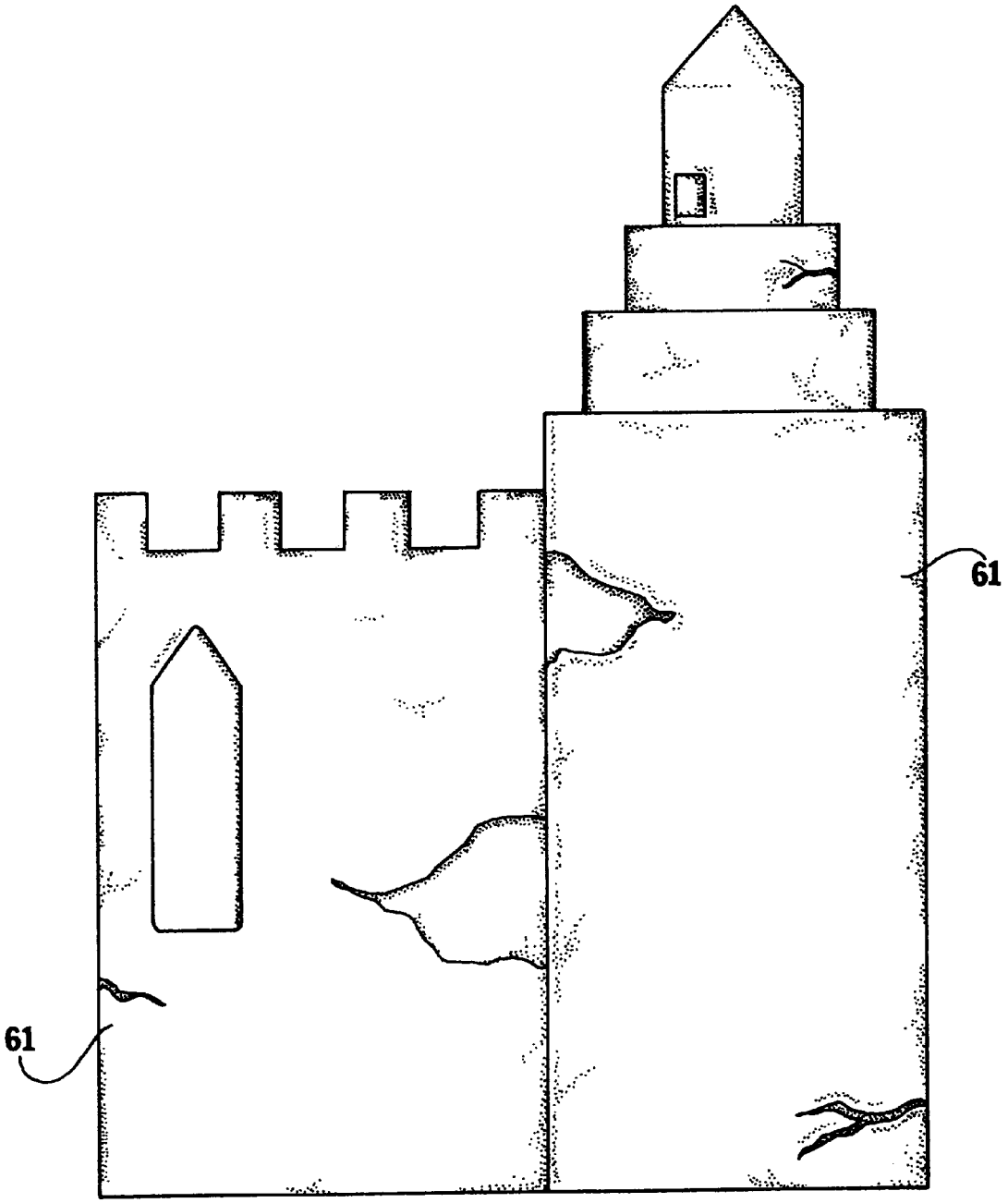
FIG. 4 is a front elevational view of two sand columns, each having a portion sculpted off.

Once the sand 51 in the mold 15 is organized in the compact rigid structure 61, the mold 15 is removed by disengaging the fastening means 20 on the left side 14 and the right side 16 of the sheet 10. Upon removal of the mold 15, the formed sand columns 61 may be sculpted thereon, as shown in FIG. 4.

Many specific details contained in the above description merely illustrate some preferred embodiments and should not be construed as a limitation on the scope of the invention. Accordingly, many other variations are possible within the spirit of the present invention, limited only by the scope of the appended claims.

What is claimed is:

1. A method of conditioning sand for sculpting thereon, using a flexible sheet having a left side, a right side, a top edge, a bottom edge, and a plurality of fastening means on the left side and the right side that engage therebetween, said method comprising the steps of:

a) Creating a mold by engaging the fastening means on the left side and the right side on the flexible sheet;

b) Filling said mold with sand up to a set level;

c) Pouring water into said mold and allowing the water to sift through the sand therein;

d) Replenishing the sand drained away by the poured water; and e) Repeating steps (c)–(d) until the sand level stabilizes at said set level such that no sand needs to be replenished.

2. The method of claim 1, wherein the step of creating the mold is followed by the step of placing said mold on the ground, such that the bottom edge rests securely thereon.

3. The method of claim 2, wherein the step of pouring water into said mold is followed by the step of draining the water from under the bottom edge of the adjustable mold.

* * * * *